US006428631B1

(12) United States Patent
Tomokiyo et al.

(10) Patent No.: US 6,428,631 B1
(45) Date of Patent: Aug. 6, 2002

(54) HIGH-STRENGTH STEEL SHEET HAVING EXCELLENT FORMALITY AND RESISTANCE TO SOFTENING OF THE HEAT AFFECTED ZONE AFTER WELDING

(75) Inventors: Toshimasa Tomokiyo; Hirokazu Taniguchi; Ryo Maruta, all of Tokai (JP)

(73) Assignee: Nippon Steel Corporation, Tokyo (JP)

( * ) Notice: Subject to any disclaimer, the term of this patent is extended or adjusted under 35 U.S.C. 154(b) by 0 days.

(21) Appl. No.: 09/508,916

(22) PCT Filed: Jul. 15, 1999

(86) PCT No.: PCT/JP99/03823

§ 371 (c)(1),
(2), (4) Date: Mar. 16, 2000

(87) PCT Pub. No.: WO00/04200

PCT Pub. Date: Jan. 27, 2000

(30) Foreign Application Priority Data

Jul. 16, 1998 (JP) ..... 10-202073
Apr. 15, 1999 (JP) ..... 11-107587
Apr. 15, 1999 (JP) ..... 11-107588

(51) Int. Cl.[7] ..... C22C 38/12; C22C 38/16; C22C 38/02; C22C 38/04; C22C 38/08

(52) U.S. Cl. ..... 148/306; 148/320; 420/127; 420/128; 420/123

(58) Field of Search ..... 420/127, 128, 420/123; 148/320, 336

(56) References Cited

U.S. PATENT DOCUMENTS 5,634,988 A * 6/1997 Kurebayashi et al. ..... 148/320

FOREIGN PATENT DOCUMENTS

| | | |
|---|---|---|
| JP | 3-199343 | 8/1991 |
| JP | 3-264646 | 11/1991 |
| JP | 5-186849 | 7/1993 |
| JP | 5-255805 | * 10/1993 |
| JP | 7-026346 | 1/1995 |

* cited by examiner

*Primary Examiner*—Deborah Yee
(74) *Attorney, Agent, or Firm*—Kenyon & Kenyon

(57) ABSTRACT

A high-strength steel sheet having excellent fatigue property, excellent formability and resistance to softening of the heat affected zone after welding, comprising: 0.01 to 0.15 mass % of C, 0.005 to 1.0 mass % of Si, 0.1 to 2.2 mass % of Mn, 0.001 to 0.06 mass % of P, 0.001 to 0.01 mass % of S, 0.0005 to 0.01 mass % of N, 0.001 to 0.1 mass % of Al, 0.005 to 0.05 mass % of Nb, 0.05 to 0.5 mass % of Mo, when necessary, 0.001 to 0.02 mass % of Ti, 0.2 to 2.0 mass % of Cu and 0.05 to 2.0 mass % of Ni, and the remainder of Fe, wherein the components satisfy the following expression (A).

$$0.22 \geqq C(\%)+(Si/30)(\%)+(Mn/20)(\%)+(Mo/15)(\%) \quad (A)$$

15 Claims, 1 Drawing Sheet

HIGH-STRENGTH STEEL SHEET HAVING EXCELLENT FORMALITY AND RESISTANCE TO SOFTENING OF THE HEAT AFFECTED ZONE AFTER WELDING

FIELD OF THE INVENTION

The present invention relates to a high-strength steel sheet such as a high-strength hot-rolled steel sheet, a high-strength cold-rolled steel sheet or a high-strength surface-treated steel sheet, the formability after welding of which is excellent and, further, the fatigue property of which is excellent and, furthermore, the resistance to softening of the heat affected zone of which is excellent.

DESCRIPTION OF THE PRIOR ART

Conventionally, when bodies or parts for automobiles are produced, members of the automobiles are formed by means of press forming, and the thus formed members are integrated and assembled into one unit by means of spot welding or arc welding. Recently, in order to decrease the weight of an automobile body and enhance the yield of material for the object of reducing the production cost, they have made examinations into a method in which steel sheets, the mechanical strengths of which are different or the thicknesses of which are different, are integrated into one body by means of welding and then the thus integrated body is subjected to press forming. In order to reduce the weight of the automobile body, they have positively examined a method of applying high-strength steel sheets to the automobile body.

However, since the steel sheet has a weld zone and a heat affected zone, the following problems may be encountered in the process of press forming the sheet after welding. The formability of the steel sheet is deteriorated due to the cracks created in the process of press forming, which are not realized in the conventional manufacturing process in which welding is conducted after the process of press forming. Further, material in the heat affected zone is softened in the process of press forming, which is not realized in the conventional manufacturing process, either.

Improvements in the mechanical strength of the weld zone itself have been proposed by JP-A-3-199343, JP-A-5-186849 and others. However, in the techniques proposed by the above patent publications, forming is not conducted after welding. Therefore, the techniques proposed by the above patent publications are different from the technique in which press forming is conducted after welding. Concerning a method of enhancing the formability of a steel sheet after it has been welded, JP-A-7-26346 proposes such a method. According to this method, the components of ultra-low carbon steel are optimized so as to enhance the formability of a steel sheet after it has been welded. This method can realize excellent formability after welding compared with the formability of a conventional ultra-low carbon steel, however, the following problems may be encountered in this method.

The method of the above proposal is related to ultra-low carbon steel, the mechanical strength of which is relatively low. In order to further reduce the weight of an automobile body, it is necessary to apply the method to material of high mechanical strength. However, when the above method is applied to a high-strength steel sheet, the formability of the steel sheet after welding has not been clearly explained in a technical standpoint. Further, after the steel sheet has been welded, the mechanical strength of the steel sheet in the heat affected zone is deteriorated, that is, the heat affected zone is softened. For the above reasons, the reliability of the product is not high.

The parts used for an automobile are given a repeated load when the automobile is running. Therefore, it is desirable that the fatigue properties of both the base metal and the weld zone are excellent.

Concerning the fatigue property of a high-strength steel sheet, a large number of proposals have been made for a high-strength hot-rolled steel sheet, and a few proposals have been made for a high-strength cold-rolled steel sheet and a high-strength surface-treated steel sheet. In the above circumstances, there is proposed a technique, in JP-A-3-264646, in which the fatigue property can be improved when the steel structure is made to be a dual phase structure. However, according to the above technique, the press forming property after welding has not been clearly explained in a technical standpoint. That is, steel sheets in which the fatigue property and the press formability after welding are compatible with each other are not provided.

SUMMARY OF THE INVENTION

An object of the present invention is to solve the above problems. That is, the present invention has been accomplished to provide a high-strength steel sheet such as a high-strength hot-rolled steel sheet, a high-strength cold-rolled steel sheet or a high-strength surface-treated sheet, the press formability after welding of which is excellent and further the fatigue property of which is excellent, and furthermore the mechanical strength of the heat affected zone of which is not deteriorated.

In summary, the present invention to solve the above problems provides high-strength steel sheets described in the following items (1) to (8). Also, the present invention solves the above problems by providing high-strength steel sheets described in the following items (9) to (16).

(1) A high-strength steel sheet having excellent formability and resistance to softening of the heat affected zone after welding, comprising the following components expressed by mass %,
C: 0.01 to 0.15%
Si: 0.005 to 1.0%
Mn: 0.1 to 2.2%
P: 0.001 to 0.06%
S: 0.001 to 0.01%
N: 0.0005 to 0.01%
Al: 0.001 to 0.1%
Nb: 0.005 to 0.05%
Mo: 0.05 to 0.5%
Fe: principal component
where the components satisfy the following expression (A).

$$0.22 \geqq C(\%)+(Si/30)(\%)+(Mn/20)(\%)+(Mo/15)(\%) \quad (A)$$

(2) A high-strength steel sheet having excellent formability and resistance to softening of the heat affected zone after welding, comprising the following components expressed by mass %,
C: 0.01 to 0.15%
Si: 0.005 to 1.0%
Mn: 0.1 to 2.2%
P: 0.001 to 0.06%
S: 0.001 to 0.01%
N: 0.0005 to 0.01%
Al: 0.001 to 0.1%
Nb: 0.005 to 0.05%
Mo: 0.05 to 0.5%

Fe: principal component where the components satisfy the following expression (A), and the dislocation density per plane visual field of 1 $\mu m^2$ is not less than $50/\mu m^2$ and not more than $10{,}000/\mu m^2$.

$$0.22 \geqq C(\%)+(Si/30)(\%)+(Mn/20)(\%)+(Mo/15)(\%) \quad (A)$$

(3) A high-strength steel sheet having excellent formability and resistance to softening of the heat affected zone after welding, comprising the following components expressed by mass %, C: 0.01 to 0.15%
Si: 0.005 to 1.0%
Mn: 0.1 to 2.2%
P: 0.001 to 0.06%
S: 0.001 to 0.01%
N: 0.0005 to 0.01%
Al: 0.001 to 0.1%
Nb: 0.005 to 0.05%
Mo: 0.05 to 0.5%
Ti: 0.001 to 0.02%
Fe: principal component where the components satisfy the following expression (A).

$$0.22 \geqq C(\%)+(Si/30)(\%)+(Mn/20)(\%)+(Mo/15)(\%) \quad (A)$$

(4) A high-strength steel sheet having excellent formability and resistance to softening of the heat affected zone after welding, comprising the following components expressed by mass %, C: 0.01 to 0.15%
Si: 0.005 to 1.0%
Mn: 0.1 to 2.2%
P: 0.001 to 0.06%
S: 0.001 to 0.01%
N: 0.0005 to 0.01%
Al: 0.001 to 0.1%
Nb: 0.005 to 0.05%
Mo: 0.05 to 0.5%
Ti: 0.001 to 0.02%
Fe: principal component where the components satisfy the following expression (A), and the dislocation density per plane visual field of 1 $\mu m^2$ is not less than $50/\mu m^2$ and not more than $10{,}000/\mu m^2$.

$$0.22 \geqq C(\%)+(Si/30)(\%)+(Mn/20)(\%)+(Mo/15)(\%) \quad (A)$$

(5) A high-strength steel sheet having excellent formability and resistance to softening of the heat affected zone after welding, according to items (1), (2), (3) or (4), wherein the high-strength steel sheet is a high-strength hot-rolled steel sheet.

(6) A high-strength steel sheet having excellent formability and resistance to softening of the heat affected zone after welding, according to items (1), (2), (3) or (4), wherein the high-strength steel sheet is a high-strength cold-rolled steel sheet.

(7) A high-strength steel sheet having excellent formability and resistance to softening of the heat affected zone after welding, according to items (1), (2), (3), (4), (5) or (6), wherein the high-strength steel sheet is a high-strength surface-treated steel sheet.

(8) A high-strength surface-treated steel sheet having excellent formability and resistance to softening of the heat affected zone after welding, according to item (7), wherein the high-strength surface-treated steel sheet is a high-strength galvanized steel sheet.

(9) A high-strength steel sheet having excellent fatigue property, excellent formability and resistance to softening of the heat affected zone after welding, comprising the following components expressed by mass %, C: 0.01 to 0.15%
Si: 0.005 to 1.0%
Mn: 0.1 to 2.2%
P: 0.001 to 0.06%
S: 0.001 to 0.01%
N: 0.0005 to 0.01%
Al: 0.001 to 0.1%
Nb: 0.005 to 0.05%
Mo: 0.05 to 0.5%
Cu: 0.2 to 2.0%
Ni: 0.05 to 2.0%
Fe: principal component where the components satisfy the following expression (A).

$$0.22 \geqq C(\%)+(Si/30)(\%)+(Mn/20)(\%)+(Mo/15)(\%) \quad (A)$$

(10) A high-strength steel sheet having excellent fatigue property, excellent formability and resistance to softening of the heat affected zone after welding, comprising the following components expressed by mass %, C: 0.01 to 0.15%
Si: 0.005 to 1.0%
Mn: 0.1 to 2.2%
P: 0.001 to 0.06%
S: 0.001 to 0.01%
N: 0.0005 to 0.01%
Al: 0.001 to 0.1%
Nb: 0.005 to 0.05%
Mo: 0.05 to 0.5%
Cu: 0.2 to 2.0%
Ni: 0.05 to 2.0%
Fe: principal component where the components satisfy the following expression (A), and the dislocation density per plane visual field of 1 $\mu m^2$ is not less than $50/\mu m^2$ and not more than $10{,}000/\mu m^2$.

$$0.22 \geqq C(\%)+(Si/30)(\%)+(Mn/20)(\%)+(Mo/15)(\%) \quad (A)$$

(11) A high-strength steel sheet having excellent fatigue property, excellent formability and resistance to softening of the heat affected zone after welding, comprising the following components expressed by mass %, C: 0.01 to 0.15%
Si: 0.005 to 1.0%
Mn: 0.1 to 2.2%
P: 0.001 to 0.06%
S: 0.001 to 0.01%
N: 0.0005 to 0.01%
Al: 0.001 to 0.1%
Nb: 0.005 to 0.05%
Mo: 0.05 to 0.5%
Ti: 0.001 to 0.02%
Cu: 0.2 to 2.0%
Ni: 0.05 to 2.0%
Fe: principal component where the components satisfy the following expression (A).

$$0.22 \geqq C(\%)+(Si/30)(\%)+(Mn/20)(\%)+(Mo/15)(\%) \quad (A)$$

(12) A high-strength steel sheet having excellent fatigue property, excellent formability and resistance to softening of the heat affected zone after welding, comprising the following components expressed by mass %, C: 0.01 to 0.15%
Si: 0.005 to 1.0%
Mn: 0.1 to 2.2%
P: 0.001 to 0.06%
S: 0.001 to 0.01%
N: 0.0005 to 0.01%
Al: 0.001 to 0.1%
Nb: 0.005 to 0.05%
Mo: 0.05 to 0.5%
Ti: 0.001 to 0.02%
Cu: 0.2 to 2.0%
Ni: 0.05 to 2.0%
Fe: principal component where the components satisfy the following expression (A), and the dislocation density per plane visual field of 1 $\mu m^2$ is not less than $50/\mu m^2$ and not more than $10{,}000/\mu m^2$.

$$0.22 \geq C(\%)+(Si/30)(\%)+(Mn/20)(\%)+(Mo/15)(\%) \quad (A)$$

(13) A high-strength steel sheet having excellent fatigue property, excellent formability and resistance to softening of the heat affected zone after welding, according to items (9), (10), (11) or (12), wherein the high-strength steel sheet is a high-strength hot-rolled steel sheet.

(14) A high-strength steel sheet having excellent fatigue property, excellent formability and resistance to softening of the heat affected zone after welding, according to items (9), (10), (11) or (12), wherein the high-strength steel sheet is a high-strength cold-rolled steel sheet.

(15) A high-strength steel sheet having excellent fatigue property, excellent formability and resistance to softening of the heat affected zone after welding, according to items (9), (10), (11), (12), (13) or (14), wherein the high-strength steel sheet is a high-strength surface-treated steel sheet.

(16) A high-strength surface-treated steel sheet having excellent fatigue property, excellent formability and resistance to softening of the heat affected zone after welding, according to item (15), wherein the high-strength surface-treated steel sheet is a high-strength galvanized steel sheet.

THE MOST PREFERRED EMBODIMENT

Figure 1:
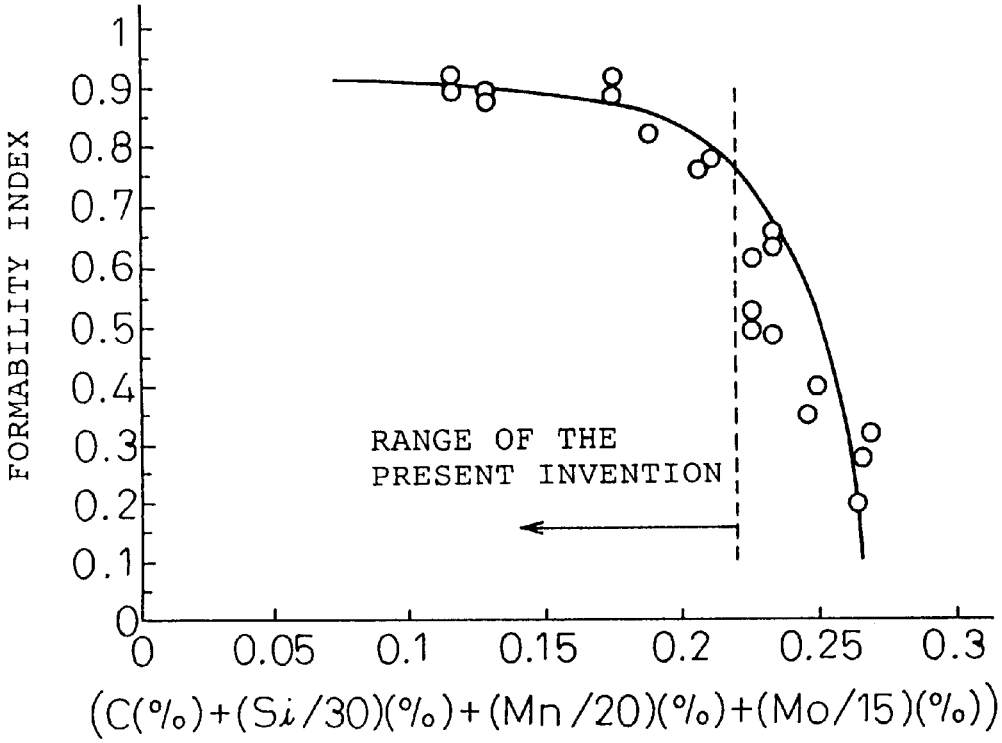
FIG. 1 is a view showing the influence of the right side (C(%)+(Si/30)(%)+(Mn/20)(%)+(Mo/15)(%)) of the expression (A) on the formability index.

In order to discover a method of preventing a heat affected zone from softening while the press formability of a steel sheet after welding is kept good, the present inventors made an investigation into steel sheets and welding methods. First, the present inventors made an investigation into the formability of steel sheets after welding. As a result of the investigation, the present inventors found the following. In the case of welding a high-strength steel sheet, the strength of a base metal, the strength of a weld zone and the strength of a heat affected zone are changed by the heat history. Accordingly, the press formability of the high-strength steel sheet after welding is determined as a result of the interaction between strength-ductility of the base metal and strength-ductility of the weld zone and the heat affected zone. Further, the present inventors found the following. In the case where the steel sheet contains C, Si, Mn, P, S, Al, N, Mo, Nb, Ti, Cu and Ni, the formability after welding can be improved when the contents of Mo, Mn, Si and C satisfy a predetermined relational expression.

As a result of the investigation into a method of preventing the heat affected zone from softening, the present inventors discovered that the compound addition of Nb and Mo is effective. The reason why the compound addition of Nb and Mo is effective is considered to be as follows. When Nb and Mo are added in a compound state, even if the temperature of a steel sheet is raised by welding, the extinction of dislocations in the steel sheet is suppressed. Therefore, the dislocations become precipitation nuclei, and (Nb, Mo)C is precipitated in a short period of time, so that the heat affected zone can be prevented from softening. Further, the present inventors obtained the following knowledge. In order to more clearly exhibit the effect of preventing the heat affected zone from softening, it is preferable that the dislocation density per 1 $\mu m^2$ of plane visual field on the sheet is not less than $50/\mu m^2$.

The present invention will be explained in detail as follows.

First, the reason why the content of each component of steel is limited to a predetermined range is described below.

C is an indispensable element for maintaining the mechanical strength of a base metal. In order to maintain the mechanical strength and precipitate (Nb, Mo)C in the process of welding at the same time so as to prevent the heat affected zone from softening, it is necessary for the base metal to contain C at not less than 0.01%. However, when the carbon content is excessively increased, the workability of the base metal is deteriorated, and at the same time the weld zone is remarkably hardened and the ductility is lowered. Therefore, the upper limit of the carbon content is kept at 0.15%.

Si is an auxiliary element for obtaining the mechanical strength of a base metal. In order to reduce the content of Si to be lower than 0.005%, the production cost is increased, that is, it is not economical. Therefore, the lower limit of the content of Si is set at 0.005%. When the content of Si exceeds 1.0%, the cost of descaling is increased in the process of hot rolling, which is not economical. Therefore, the upper limit of the content of Si is set at 1.0%.

Mn is an element for ensuring the mechanical strength of a base metal. When the content of Mn is lower than 0.1%, the cost is increased in the process of refining, which is not economical. Therefore, the lower limit of the content of Mn is set at 0.1%. When the content of Mn exceeds 2.2%, the workability of the base metal is deteriorated and, at the same time, the formability of the weld zone is deteriorated. Therefore, the upper limit of the content of Mn is set at 2.2%.

In order to reduce the content of P to a value lower than 0.001%, the cost is industrially raised. Therefore, the lower limit of P is set at 0.001%. When the content of P exceeds 0.06%, the occurrence of coagulating segregation becomes remarkable in the process of casting, which causes cracks inside and deteriorates the formability, and at the same time causes embrittlement of the weld zone and deteriorates the formability of the weld zone. Therefore, the upper limit of the content of P is set at 0.06%.

In order to reduce the content of S to a value lower than 0.001%, the production cost is raised. Therefore, the lower limit of the content of S is set at 0.001%. When the content of S exceeds 0.01%, hot shortness is caused. Therefore, the upper limit of the content of S is set at 0.01%.

Al is an element necessary for deoxidation. When the content of Al is lower than 0.001%, it becomes impossible to conduct deoxidation sufficiently, and defects such as pin holes are caused. Therefore, the lower limit of the content of Al is set at 0.001%. When the content of Al exceeds 0.1%, the quantity of inclusions such as alumina is increased, and the ductility of steel is impaired. Therefore, the upper limit of the content of Al is set at 0.1%.

N is related to the precipitation of (Nb, Mo)C and is contained in the precipitate in a very small quantity. Therefore, N is contained in a value not less than 0.0005%. When the content of N exceeds 0.01%, NbN is precipitated in the process of hot rolling, and the quantity of Nb, which is effective for preventing the heat affected zone from softening, is reduced. Therefore, the upper limit of the content of N is set at 0.01%.

Nb is effective for preventing the heat affected zone from softening together with Mo. Therefore, Nb is an indispensable element for the present invention. When the content of Nb is lower than 0.005%, the corrosion resistance is deteriorated and further no effect can be provided for preventing the heat affected zone from softening. Therefore, the lower limit of the content of Nb is set at 0.005%. In order to provide a greater effect of preventing the heat affected zone from softening, it is preferable that the content of Nb is a value not less than 0.01%. However, when the content of Nb exceeds 0.05%, the workability of the base metal is deteriorated. Therefore, the upper limit of the content of Nb is set at 0.05%.

Mo is an element effective for preventing the heat affected zone from softening when it is added by compound addition with Nb. Therefore, Mo is an essential element for the present invention. When the content of Mo is lower than 0.05%, no effect can be provided of preventing the heat affected zone from softening. Therefore, the lower limit of the content of Mo is set at 0.05%. When the content of Mo exceeds 0.5%, the effect of Mo is saturated, and further the quantity of the precipitated inclusions, which become a cause of defects, is increased. Therefore, the upper limit of the content of Mo is set at 0.5%.

Ti is an element that enhances the formability after welding by fixing C, N and S. In order to obtain a sufficiently high effect, it is necessary to add Ti, the quantity of which is not less than 0.001%. However, when an excessively large quantity of Ti is added, a large quantity of carbonitride are precipitated, and the workability of the base metal is deteriorated. Therefore, the upper limit of Ti is set at 0.02%.

Cu is an element effective for improving the fatigue property. When the content of Cu is lower than 0.2%, it is impossible to provide the effect of improving the fatigue property. Therefore, the lower limit of the content of Cu is set at 0.2%. When the content of Cu exceeds 2.0%, the effect of improving the fatigue property is saturated, and further the production cost is raised. Therefore, the upper limit of the content of Cu is set at 2.0%.

Ni is an element for suppressing the occurrence of surface defects (Cu-scab) caused by Cu in the process of hot rolling a steel sheet to which Cu is added, so that the surface quality of the steel sheet can be kept high and the occurrence of hot brittleness can be prevented. Therefore, Ni is added to a quantity not less than 0.05%. In this case, if Ni is added to a quantity exceeding 2.0%, the effect of improving the surface quality is saturated, and further the production cost is raised. Therefore, the upper limit of the content of Ni is set at 2.0%. In this connection, the effect of adding Ni is exhibited according to a quantity of added Cu. Therefore, it is preferable that Ni is added in a range of Ni/Cu: 0.25 to 0.60.

In the present invention, it is important that the quantities of C, Si, Mn and Mo to be added satisfy the following expression (A).

$$0.22 \geqq C(\%)+(Si/30)(\%)+(Mn/20)(\%)+(Mo/15)(\%) \quad (A)$$

The present inventors made punch-stretch forming tests on high-strength steel sheets of various compositions after the steel sheets which-had the same components had been subjected to butt welding, and a relation between the value of the right side of the above expression and the punch-stretch forming height was investigated. The result of the investigation is shown in FIG. 1. The horizontal axis represents a value calculated by the right side of the expression (A), and the vertical axis represents a value (formability index) which is obtained when the punch-stretch height of a steel sheet after welding is divided by the punch-stretch height of the steel sheet before welding and the thus obtained values are standardized. It can be said that the more excellent the formability index, the more excellent the formability after welding. As can be seen in FIG. 1, when the expression (A) is satisfied, that is, when the quantities of C, Si, Mn and Mo to be added comply with the expression (A) of the present invention, the formability index of the high-strength steel sheet of the present is high. Therefore, the high-strength steel sheet of the present is excellent in formability.

When too much C, Si, Mn and Mo are added so as to enhance the mechanical strength of the weld zone and the heat affected zone, the ductility of the weld zone and the heat affected zone is deteriorated. As a result, the formability of the steel sheet after welding is deteriorated.

Data shown in FIG. 1 was obtained by various welding methods such as TIG (Tungsten Inert Gas shielded arc) welding, plasma welding, laser welding and seam welding (mash seam welding). According to the present invention, even when the welding method is different, the formability after welding becomes substantially the same as long as the quantities of C, Si, Mn and Mo to be added satisfy the expression (A).

Elements Cr, B, V, Ca and Mg, which are inevitably contained in steel, do not harm the characteristic of the high-strength steel sheet of the present invention. However, when the quantities of Cr, B, V, Ca and Mg are large, the recrystallization temperature is raised, and further the rolling property of the steel sheet is deteriorated, that is, it becomes difficult to produce a steel sheet by rolling. Therefore, the contents of these inevitable elements are preferably restricted in such a manner that Cr is not more than 0.1%, both Mg and Ca are not more than 0.01%, B is not more than 0.005%, and V is not more than 0.01%.

Concerning the method of producing the steel sheet of the present invention, the conditions for the method can be appropriately selected according to the use and necessary characteristic of the steel sheet.

For example, the high-strength steel sheet of the present invention can be produced by the following method. First of all, steel, the composition of which is adjusted to be in the range described before, is made in a converter and cast to be a slab by the continuous casting method. The thus obtained slab, at a high temperature, is put into a furnace, or alternatively the thus obtained slab, at a high temperature, is cooled to a room temperature and then put into a furnace. In the furnace, the slab is heated to the temperature range from 1000 to 1250° C. After that, the slab is finish-rolled in the temperature range from 800 to 950° C. and coiled at a temperature not higher than 700° C. A hot-rolled steel sheet is made in this way. Next, the hot-rolled steel sheet is pickled in an acid bath and cold-rolled by a cold-rolling mill and annealed in an annealing furnace. A cold-rolled steel sheet is made in this way. In the case of producing a high-strength surface-treated steel sheet, the hot-rolled steel sheet or the cold-rolled steel sheet is plated. It is preferable that the annealing temperature is not less than 700° C. and lower than 900° C. When the annealing temperature is lower than 700° C., the steel sheet is not sufficiently recrystallized, and it is difficult to provide a stable workability of the base metal. For this reason, the lower limit of the annealing temperature is set at 700° C. When the annealing temperature exceeds 900° C., the crystal grain size of the base metal becomes too large, and the steel sheet surface becomes too rough in the case of press forming. Therefore, the upper limit of the annealing temperature is set at 900° C.

Most high-strength surface-treated steel sheets which are used for automobiles, electric appliances and construction materials are hot-dip galvanized steel sheets.

When a steel sheet is galvanized, hot-dip galvanization is conducted on the steel sheet simultaneously with annealing by the same apparatus or the same line as that of annealing. A quantity of plating conducted on the steel sheet surface is 3 mg/m$^2$ to 800 g/m$^2$. When the quantity of plating conducted on the steel sheet surface is smaller than 3 mg/m$^2$, it is impossible to exhibit the effect of corrosion resistance, that is, it is impossible to accomplish the object of plating. When the quantity of plating conducted on the steel sheet surface exceeds 800 g/m$^2$, surface defects such as blow holes tend to occur in the process of welding. For the above reasons, the quantity of plating is kept in the range from 3 mg/m$^2$ to 800 g/m$^2$.

Even when electroplating is conducted or an organic compound coating is formed on a steel sheet surface after the completion of annealing, the same effect as that of a case in which hot-dip galvanization is conducted simultaneously with annealing can be provided by the present invention.

In the case of the thus obtained high-strength hot-rolled steel sheet, high-strength cold-rolled steel sheet or high-strength surface-treated steel sheet (for example, hot-dip galvanized steel sheet), when the dislocation density per 1 $\mu$m$^2$ of plane visual field is not less than 50/$\mu$m$^2$, it is possible to prevent the heat affected zone from softening. Although the dislocation density fluctuates by the location and orientation, when the number of dislocations is measured in 10 visual fields of a transmission electron microscope and the measured value is not less than 50/$\mu$m$^2$, (Nb, Mo)C created in the process of welding is precipitated in a short period of time, and softening of the heat affected zone can be suppressed more effectively. When the dislocation density exceeds 10,000/$\mu$m$^2$, the press formability is deteriorated, that is, there is a possibility that cracks are caused. Therefore, the upper limit of the dislocation density is set at 10,000/$\mu$m$^2$. In this connection, in the case of a usually annealed steel sheet, the dislocation density is 5 to 20/$\mu$m$^2$. Therefore, the above effect can be provided when the plastic strain of not less than 1.0% and lower than 10.0% as elongation is given to the steel sheet. Examples of the method of giving strain are a method of skin-pass rolling and a method of giving tensile strain after the sheet has been cut down. In this way, it is possible to provide a high-strength steel sheet such as a high-strength hot-rolled steel sheet, a high-strength cold-rolled steel sheet or a high-strength surface-treated steel sheet, the formability after welding of which is excellent and the heat affected zone of which seldom softens.

EXAMPLES

Example 1-1

Steels, the compositions of which are shown on Table 1, were made in a converter and formed into slabs by means of continuous casting. After that, the slabs were hot-rolled into high-strength hot-rolled steel sheets, the thickness of which was 2.0 mm. Further, the same slabs were hot-rolled and cold-rolled into high-strength cold-rolled steel sheets, the thickness of which was 1.4 mm. After that, some of the steel sheets were subjected to hot-dip galvanization (45 g/m$^2$), so that high-strength surface-treated steel sheets were obtained. Plastic strain was given to the steel sheets by skin-pass rolling.

The thus produced high-strength steel sheets were subjected to tensile tests (JIS Z 2201). The dislocation density on the steel sheets was measured. The dislocation density was measured by a transmission electron microscope in such a manner that the number of dislocations per 1 $\mu$m$^2$ of a plane visual field was measured with respect to 10 visual fields, and the average was determined to be the dislocation density. The result of the measurement are shown on Tables 1 and 2.

The thus obtained high-strength steel sheets of the same steel were butt-welded, and the characteristics of the welded portions were evaluated after welding. Welding was conducted by means of laser welding (laser power: 2 kW, welding speed: 2 m/min, shield gas: Ar (20 L/min)).

Figure 2:
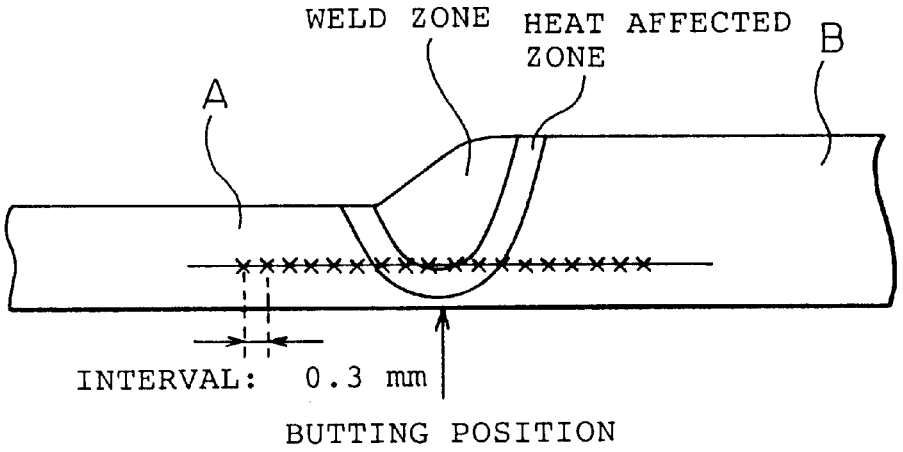
FIG. 2 is a view showing an outline of the measurement position and interval in the case of measuring the hardness of a heat affected zone.

Concerning the characteristics of the welded portions after welding, the formability and the softening state of the heat affected zone were investigated and evaluated. The formability was evaluated by the Erichsen Test (JIS Z 2247 Method B), and the formability index was obtained when the critical punch-stretch height of the weld zone was divided by the critical punch-stretch height of the base metal. The softening state of the heat affected zone was investigated in such a manner that the hardness on a section including the weld zone was measured by the Vickers hardness tester (load: 0.98 kN) as shown in FIG. 2. Measurement of the hardness was made as follows. Measurement was made at positions of ½ of the sheet thickness, and the intervals of measurement were set at 0.3 mm. Under the above measuring condition, a difference between the hardness of the base metal and that of the most softened portions was measured. The resistance to softening of the heat affected zone was evaluated by the result of the measurement. The results are shown on Table 2.

Example 1-2

In this example, some of the slabs made of steel, the composition of which is shown on Table 1, were used, and high-strength cold-rolled steel sheets and high-strength surface-treated steel sheets, the final sheet thickness of which was different, were produced. The production process was substantially the same as that shown on Table 1. A rolling reduction of hot-rolling was changed so as to change the sheet thickness.

These steel sheets were combined with each other, and butt welding was conducted by various welding methods such as laser welding, mash seam welding and plasma welding, and the formability and the softening state of the heat affected zone were investigated. Table 3 shows the combinations of steel sheets, welding methods, formability and results of investigation of softening state of the heat affected zone. The method of investigating the formability is the same as that shown in Example 1-1. The softening state of the heat affected zone was investigated by the same method as that of Example 1-1 as follows. The measurement of hardness was made at positions of ½ of the sheet thickness, and the interval of the measuring positions was set at 0.3 mm.

The welding conditions of each welding method is described as follows. Concerning the laser welding method, the welding conditions are that welding speed: 2 m/min, and shield gas: Ar (20 L/min). Concerning the plasma welding method, the welding conditions are that welding speed: 0.7 m/min, and shield gas: Ar (6 L/min). Concerning the mash seam welding, the welding conditions are that welding speed: 4 m/min, force given to the weld portion: 10 kN, and lap: 2 mm. Heat input in each welding method is determined to be the maximum heat input by which the burn-through of the weld zone and the expulsion are not caused. In the process of welding, the heat input was appropriately changed.

As the results of the investigation are shown on Table 3, compared with the case in which the steel sheets of relative examples are combined with each other, the case in which the steel sheets of the present invention are combined with each other is superior in the formability after welding and in the resistance to softening of the heat affected zone. The case in which the steel sheets of the present invention are combined with the steel sheets of the comparative examples is superior to the case in which the steel sheets of the comparative examples are combined with each other in the formability although the heat affected zone starts to soften.

TABLE 1

| | | Type of | Composition (%) | | | | | | | | | | Value of right side of expression |
|---|---|---|---|---|---|---|---|---|---|---|---|---|---|
| | No. | steel | C | Si | Mn | P | S | Al | N | Ti | Nb | Mo | (A) |
| Steel sheet of present invention | A1 | Cold rolled steel sheet | 0.01 | 0.46 | 0.15 | 0.030 | 0.002 | 0.045 | 0.0030 | 0 | 0.020 | 0.23 | 0.05 |
| | A2 | Cold rolled steel sheet | 0.01 | 0.46 | 0.60 | 0.025 | 0.008 | 0.033 | 0.0025 | 0 | 0.010 | 0.15 | 0.07 |
| | A3 | Cold rolled steel sheet | 0.02 | 0.51 | 0.15 | 0.040 | 0.009 | 0.025 | 0.0023 | 0 | 0.030 | 0.18 | 0.06 |
| | A4 | Cold rolled steel sheet | 0.05 | 0.30 | 0.15 | 0.033 | 0.006 | 0.018 | 0.0040 | 0 | 0.030 | 0.22 | 0.08 |
| | A5 | Cold rolled steel sheet | 0.05 | 0.68 | 0.50 | 0.015 | 0.008 | 0.070 | 0.0035 | 0.015 | 0.040 | 0.25 | 0.11 |
| | A6 | Cold rolled steel sheet | 0.05 | 0.81 | 1.00 | 0.023 | 0.010 | 0.006 | 0.0028 | 0.010 | 0.020 | 0.27 | 0.15 |
| | A7 | Cold rolled steel sheet | 0.08 | 0.61 | 1.20 | 0.040 | 0.003 | 0.040 | 0.0026 | 0.010 | 0.040 | 0.26 | 0.18 |
| | A8 | Cold rolled steel sheet | 0.10 | 0.86 | 1.25 | 0.014 | 0.005 | 0.025 | 0.0022 | 0 | 0.050 | 0.35 | 0.21 |
| | A9 | Cold rolled steel sheet | 0.08 | 0.01 | 1.48 | 0.014 | 0.006 | 0.048 | 0.0031 | 0.011 | 0.014 | 0.30 | 0.17 |
| | A10 | Cold rolled steel sheet | 0.06 | 0.20 | 0.96 | 0.011 | 0.005 | 0.017 | 0.0027 | 0 | 0.007 | 0.07 | 0.12 |
| | A11 | Hot rolled steel sheet | 0.05 | 0.68 | 0.50 | 0.015 | 0.008 | 0.070 | 0.0035 | 0.015 | 0.040 | 0.25 | 0.11 |
| | A12 | Hot rolled steel sheet | 0.05 | 0.68 | 0.50 | 0.015 | 0.008 | 0.070 | 0.0035 | 0.015 | 0.040 | 0.25 | 0.11 |

TABLE 1-continued

| | | | | | | | | | | | | | |
|---|---|---|---|---|---|---|---|---|---|---|---|---|---|
| Steel sheet of comparative example | B1 | Cold rolled steel sheet | 0.01 | 0.46 | 0.15 | 0.030 | 0.002 | 0.045 | 0.0030 | 0.010 | 0 | 0 | 0.03 |
| | B2 | Cold rolled steel sheet | 0.12 | 0.28 | 1.50 | 0.040 | 0.005 | 0.018 | 0.0040 | 0.010 | 0.030 | 0.45 | 0.23 |
| | B3 | Cold rolled steel sheet | 0.20 | 0.22 | 1.00 | 0.042 | 0.006 | 0.018 | 0.0040 | 0 | 0.030 | 0.22 | 0.27 |
| | B4 | Cold rolled steel sheet | 0.15 | 0.41 | 1.30 | 0.036 | 0.002 | 0.045 | 0.0030 | 0.015 | 0.020 | 0.15 | 0.24 |
| | B5 | Cold rolled steel sheet | 0.12 | 0.35 | 1.80 | 0.047 | 0.005 | 0.035 | 0.0035 | 0.010 | 0.030 | 0.40 | 0.25 |
| | B6 | Cold rolled steel sheet | 0.03 | 0.62 | 0.20 | 0.022 | 0.005 | 0.040 | 0.0025 | 0.010 | 0 | 0.30 | 0.08 |
| | B7 | Cold rolled steel sheet | 0.15 | 0.50 | 1.65 | 0.018 | 0.005 | 0.039 | 0.0036 | 0 | 0.021 | 0 | 0.25 |
| | B8 | Cold rolled steel sheet | 0.06 | 0.20 | 0.96 | 0.011 | 0.005 | 0.017 | 0.0027 | 0 | 0.040 | 0 | 0.11 |
| | B9 | Hot rolled steel sheet | 0.12 | 0.28 | 1.50 | 0.040 | 0.005 | 0.018 | 0.0040 | 0.010 | 0.030 | 0.45 | 0.25 |
| | B10 | Hot rolled steel sheet | 0.12 | 0.46 | 0.15 | 0.030 | 0.002 | 0.045 | 0.0030 | 0.010 | 0 | 0 | 0.03 |

| | | Hot rolling condition (° C.) | | Annealing | | Elongation | Dis- |
|---|---|---|---|---|---|---|---|
| | No. | Heating temperature | Coiling temperature | temperature (° C.) | Presence of plating | ratio of skinpass (%) | location density ( /μm$^2$) |
| Steel sheet of present invention | A1 | 1170 | 480 | 810 | No | 2.0 | 83 |
| | A2 | 1100 | 450 | 850 | No | 1.5 | 63 |
| | A3 | 1050 | 440 | 880 | No | 1.2 | 63 |
| | A4 | 1030 | 480 | 805 | No | 1.5 | 62 |
| | A5 | 1180 | 470 | 830 | No | 3.0 | 123 |
| | A6 | 1140 | 430 | 810 | No | 1.8 | 65 |
| | A7 | 1100 | 490 | 850 | No | 1.5 | 76 |
| | A8 | 1120 | 300 | 820 | Galvanization | 1.2 | 53 |
| | A9 | 1180 | 550 | 810 | Galvanization | 1.5 | 62 |
| | A10 | 1150 | 500 | 805 | Galvanization | 1.5 | 63 |
| | A11 | 1180 | 470 | — | No | 1.5 | 62 |
| | A12 | 1180 | 470 | — | Galvanization | 1.5 | 61 |
| Steel sheet of comparative example | B1 | 1150 | 490 | 770 | No | 1.0 | 49 |
| | B2 | 1250 | 480 | 810 | No | 0.8 | 45 |
| | B3 | 1280 | 680 | 820 | No | 0 | 10 |
| | B4 | 1250 | 700 | 800 | No | 0 | 15 |
| | B5 | 1230 | 420 | 780 | No | 0 | 23 |
| | B6 | 1200 | 560 | 770 | Galvanization | 0 | 17 |
| | B7 | 1050 | 500 | 810 | Galvanization | 1.0 | 51 |
| | B8 | 1150 | 550 | 805 | Galvanization | 1.2 | 53 |
| | B9 | 1280 | 680 | — | No | 1.5 | 67 |
| | B10 | 1150 | 490 | — | Galvanization | 1.5 | 63 |

TABLE 2

| | | | Formability | | Softening characteristic of heat affected zone | | | |
|---|---|---|---|---|---|---|---|---|
| | | | | | Hardness (HvO.1) | | | |
| | No. | Tensile strength ($N/mm^2$) | Form-ability index | Judgment of form-ability *1 | Base metal | Most softening portion | Differ-ence | Judgment of softening ratio *2 |
| Steel sheet of present invention | A1 | 422 | 0.95 | ○ | 140 | 140 | 0 | ○ |
| | A2 | 471 | 0.92 | ○ | 150 | 148 | 2 | ○ |
| | A3 | 481 | 0.90 | ○ | 152 | 150 | 2 | ○ |
| | A4 | 520 | 0.89 | ○ | 161 | 158 | 3 | ○ |
| | A5 | 549 | 0.91 | ○ | 170 | 170 | 0 | ○ |
| | A6 | 608 | 0.92 | ○ | 182 | 181 | 1 | ○ |
| | A7 | 696 | 0.89 | ○ | 205 | 203 | 2 | ○ |
| | A8 | 785 | 0.82 | ○ | 221 | 220 | 1 | ○ |
| | A9 | 598 | 0.88 | ○ | 196 | 195 | 1 | ○ |
| | A10 | 500 | 0.86 | ○ | 161 | 155 | 9 | ○ |
| | A11 | 520 | 0.89 | ○ | 168 | 167 | 1 | ○ |
| | A12 | 520 | 0.89 | ○ | 168 | 168 | 0 | ○ |
| Steel sheet of comparative example | B1 | 392 | 0.93 | ○ | 138 | 108 | 30 | x |
| | B2 | 667 | 0.75 | x | 198 | 197 | 1 | ○ |
| | B3 | 598 | 0.35 | x | 182 | 180 | 2 | ○ |
| | B4 | 686 | 0.53 | x | 203 | 199 | 4 | ○ |
| | B5 | 686 | 0.76 | x | 202 | 202 | 0 | ○ |
| | B6 | 422 | 0.92 | ○ | 141 | 123 | 18 | x |
| | B7 | 569 | 0.72 | x | 172 | 141 | 31 | x |
| | B8 | 461 | 0.89 | ○ | 153 | 123 | 30 | x |
| | B9 | 667 | 0.75 | x | 198 | 197 | 1 | ○ |
| | B10 | 382 | 0.89 | x | 135 | 103 | 32 | x |

*1) Judgment of formability: A case in which formability index > 0.8 is qualified as ○ (excellent).

*2) Judgment of softening ratio: A case in which a difference in hardness is lower than 10 is qualified as ○ (excellent).

TABLE 3

| | Combination of steel sheets | | | | | | Softening characteristic of heat affected zone | | | |
|---|---|---|---|---|---|---|---|---|---|---|
| | Type of steel | Wall thickness (nm) | Type of steel | Wall thickness (nm) | Welding method | Form-ability index *1 | Strength of base metal (HvO.1) *2 | Hardness of most softened portion (HvO.1) | Differ-ence | Judgment of softening ratio *3 |
| Steel sheet of present invention + Steel sheet of the present invention | A1 | 1.4 | A1 | 1.4 | Laser welding | 0.95 | 140 | 140 | 0 | ○ |
| | A1 | 1.4 | A9 | 1.4 | " | 0.85 | " | 139 | 1 | ○ |
| | A1 | 1.4 | A8 | 1.4 | " | 0.80 | " | 140 | 0 | ○ |
| | A1 | 1.4 | A1 | 1.4 | Mash seam welding | 0.97 | " | 138 | 2 | ○ |
| | A1 | 1.4 | A9 | 1.4 | " | 0.92 | " | 137 | 3 | ○ |
| | A1 | 1.4 | A8 | 1.4 | " | 0.82 | " | 137 | 3 | ○ |
| | A1 | 1.4 | A1 | 1.4 | Plasma welding | 0.93 | " | 140 | 0 | ○ |
| | A1 | 1.4 | A9 | 1.4 | " | 0.84 | " | 139 | 1 | ○ |
| | A1 | 1.4 | A8 | 1.4 | " | 0.79 | " | 139 | 1 | ○ |
| | A1 | 1.0 | A1 | 1.4 | Laser welding | 0.86 | 139 | 139 | 0 | ○ |
| | A1 | 1.0 | A9 | 1.4 | " | 0.84 | " | 139 | 0 | ○ |
| | A1 | 1.0 | A8 | 1.4 | " | 0.80 | " | 139 | 0 | ○ |
| | A1 | 0.8 | A1 | 1.4 | " | 0.82 | 141 | 140 | 1 | ○ |
| | A1 | 0.8 | A9 | 1.4 | " | 0.78 | " | 141 | 0 | ○ |
| | A1 | 0.8 | A8 | 1.4 | " | 0.77 | " | 140 | 1 | ○ |
| | A1 | 1.0 | A1 | 1.4 | Mash seam welding | 0.88 | 139 | 138 | 1 | ○ |
| | A1 | 1.0 | A9 | 1.4 | " | 0.85 | " | 137 | 2 | ○ |
| | A1 | 1.0 | A8 | 1.4 | " | 0.81 | " | 135 | 4 | ○ |
| | A1 | 0.8 | A1 | 1.4 | " | 0.85 | 141 | 140 | 1 | ○ |
| | A1 | 0.8 | A9 | 1.4 | " | 0.80 | " | 139 | 2 | ○ |
| | A1 | 0.8 | A8 | 1.4 | " | 0.79 | " | 139 | 2 | ○ |
| | A1 | 1.0 | A1 | 1.4 | Plasma welding | 0.84 | 139 | 139 | 0 | ○ |
| | A1 | 1.0 | A9 | 1.4 | " | 0.81 | " | 139 | 0 | ○ |
| | A1 | 1.0 | A8 | 1.4 | " | 0.80 | " | 139 | 0 | ○ |
| | A1 | 0.8 | A1 | 1.4 | " | 0.75 | 141 | 140 | 1 | ○ |
| | A1 | 0.8 | A9 | 1.4 | " | 0.70 | " | 140 | 1 | ○ |
| | A1 | 0.8 | A8 | 1.4 | " | 0.65 | " | 140 | 1 | ○ |

TABLE 3-continued

| | Combination of steel sheets | | | | | | Softening characteristic of heat affected zone | | | |
|---|---|---|---|---|---|---|---|---|---|---|
| | Type of steel | Wall thickness (nm) | Type of steel | Wall thickness (nm) | Welding method | Formability index *1 | Strength of base metal (HvO.1) *2 | Hardness of most softened portion (HvO.1) | Difference | Judgment of softening ratio *3 |
| Steel sheet of | A9 | 1.4 | B1 | 1.0 | Plasma welding | 0.93 | 138 | 108 | 30 | x |
| present | A9 | 1.4 | B1 | 1.4 | Mash seam welding | 0.95 | " | 105 | 33 | x |
| invention + | A9 | 1.4 | B1 | 1.4 | Plasma welding | 0.91 | " | 106 | 32 | x |
| Steel sheet of | A9 | 1.4 | B1 | 1.0 | Laser welding | 0.83 | 139 | 98 | 42 | x |
| the | A9 | 1.4 | B1 | 1.0 | Mash seam welding | 0.85 | " | 95 | 44 | x |
| comparative | A9 | 1.4 | B1 | 1.0 | Plasma welding | 0.80 | " | 97 | 42 | x |
| example | A9 | 1.4 | B3 | 1.4 | Laser welding | 0.67 | 182 | 181 | 1 | ○ |
| | A9 | 1.4 | B3 | 1.4 | Mash seam welding | 0.72 | " | 180 | 2 | ○ |
| | A9 | 1.4 | B3 | 1.4 | Plasma welding | 0.65 | " | 181 | 1 | ○ |
| | A9 | 1.4 | B3 | 1.0 | Laser welding | 0.65 | 180 | 180 | 0 | ○ |
| | A9 | 1.4 | B3 | 1.0 | Mash seam welding | 0.68 | " | 179 | 1 | ○ |
| | A9 | 1.4 | B3 | 1.0 | Plasma welding | 0.63 | " | 180 | 0 | ○ |
| Steel sheet of | B1 | 1.4 | B1 | 1.0 | Laser welding | 0.87 | 139 | 109 | 30 | x |
| comparative | B1 | 1.4 | B1 | 1.0 | Mash seam welding | 0.89 | " | 108 | 31 | x |
| example + | B1 | 1.4 | B1 | 1.0 | Plasma welding | 0.85 | " | 108 | 31 | x |
| steel sheet of | B1 | 1.4 | B3 | 1.4 | Laser welding | 0.36 | 138 | 105 | 33 | x |
| comparative | B1 | 1.4 | B3 | 1.4 | Mash seam welding | 0.40 | " | 100 | 38 | x |
| example | B1 | 1.0 | B3 | 1.4 | Plasma welding | 0.30 | " | 102 | 36 | x |
| | B1 | 0.8 | B3 | 1.0 | Laser welding | 0.35 | " | 110 | 28 | x |
| | B1 | 0.8 | B3 | 1.0 | Mash seam welding | 0.39 | " | 103 | 35 | x |
| | B1 | 0.8 | B3 | 1.0 | Plasma welding | 0.28 | " | 108 | 30 | x |

*1) Formability index: Formability index is a value obtained by following; the punch-stretch height of the weld zone under each condition was divided by the critical punch-stretch height of the weld zone in the case which the steel sheets of the same type of steel and the same thickness are butt-welded to each other.
*2) Hardness of base metal: In the case of a combination of steel sheets of different types of steel, hardness of a steel sheet of lower hardness was determined to be hardness of the base metal.
*3) Judgment of softening ratio: When a difference in hardness was smaller than 10, the softening ratio was determined to be ○ (excellent).

Example 2-1

Steels, the compositions of which are shown on Table 4, were made in a converter and formed into slabs by means of continuous casting. After that, the slabs were hot-rolled into high-strength hot-rolled steel sheets and then cold-rolled into high-strength cold-rolled steel sheets, the thickness of which was 1.4 mm. After that, some of the steel sheets were subjected to hot-dip galvanization (45 g/m$^2$), so that high-strength surface-treated steel sheets were obtained. Plastic strain was given to the steel sheets by skin-pass rolling.

The dislocation density on the steel sheets was measured. The dislocation density was measured by a transmission electron microscope in such a manner that the number of dislocations per 1 $\mu$m$^2$ of a plane visual field was measured with respect to 10 visual fields, and the average was determined to be the dislocation density. The result of the measurement are shown on Tables 4 and 5.

Test pieces to JIS No. 5 were made of the thus produced high-strength steel sheets, and the tensile test and the fatigue test under completely reversed plane bending were conducted in the rolling direction of the test piece. The fatigue characteristics were evaluated as follows. Stress at $10^7$ cycles was qualified as the fatigue strength ($\sigma$w), and a value ($\sigma$w/TS) obtained when the fatigue strength ($\sigma$w) was divided by tensile strength (TS), which was measured in the tensile test, was qualified as a ratio of fatigue limit. The results are shown on Table 5.

Next, the thus obtained high-strength steel sheets of the same steel were butt-welded, and the characteristics of the welded portions were evaluated after welding. Welding was conducted by means of laser welding (laser power: 2 kW, welding speed: 2 m/min, shield gas: Ar (20 L/min)).

Concerning the characteristics of the welded portions after welding, the formability and the softening state of the heat affected zone were investigated and evaluated. The formability was evaluated by the Erichsen Test (JIS Z 2247 Method B), and the formability index was obtained when the critical punch-stretch height of the weld zone was divided by the critical punch-stretch height of the base metal. The softening state of the heat affected zone was investigated in such a manner that the hardness on a section including the weld zone was measured by the Vickers hardness tester (load: 0.98 kN) at positions of ½ of the sheet thickness at the intervals of 0.3 mm as shown in FIG. 2. Under the above measuring condition, a difference between the hardness of the base metal and that of the most softened portions was measured. The resistance to softening of the heat affected zone was evaluated by the result of the measurement. The results are shown on Table 5.

As can be seen, the steel sheets of the present invention are superior to the steel sheets of the comparative examples in the fatigue characteristic of the base metal, formability after welding and resistance to softening of the heat affected zone.

Example 2-2

High-strength cold-rolled steel sheets and high-strength surface-treated steel sheets of different final thickness were produced from a portion of the slabs, the composition of which is shown on Table 4. The producing process was substantially the same as that of the producing condition shown on Table 4, and the wall thickness was changed by changing a ratio of reduction in the process of hot rolling.

These steel sheets were combined with each other, and butt welding was conducted by various welding methods such as laser welding, mash seam welding and plasma welding, and the formability and the softening state of the heat affected zone were investigated. Table 6 shows the combinations of steel sheets, welding methods, formability and results of investigation of softening state of the heat affected zone. The methods of investigating the formability and the softening state of the heat affected zone are the same as those shown in Example 2-1. The welding conditions of each welding method is described as follows. Concerning the laser welding method, the welding conditions are that welding speed: 2 m/min, and shield gas: Ar (20 L/min). Concerning the plasma welding method, the welding conditions are that welding speed: 0.7 m/min, and shield gas: Ar (6 L/min). Concerning the mash seam welding, the welding conditions are that welding speed: 4 m/min, force given to the weld portion: 10 kN, and lap: 2 mm. Heat input in each welding method is determined to be the maximum heat input by which the burn-through of the weld zone and the expulsion are not caused. In the process of welding, the heat input was appropriately changed.

As the results of the investigation are shown on Table 6, compared with the case in which the steel sheets of relative examples are combined with each other, the case in which the steel sheets of the present invention are combined with each other is superior in the formability after welding and the resistance to softening of the heat affected zone. The case in which the steel sheets of the present invention are combined with the steel sheets of the comparative examples is superior to the case in which the steel sheets of the comparative examples are combined with each other in the formability although the heat affected zone starts to soften.

TABLE 4

| | | Composition (%) | | | | | | | | | | | | | | Value of right side of expression |
|---|---|---|---|---|---|---|---|---|---|---|---|---|---|---|---|---|
| | No. | C | Si | Mn | P | S | Al | N | Ti | Nb | Mo | Cu | Ni | Ni/Cu | other | (A) |
| Steel sheet of present invention | C1 | 0.01 | 0.46 | 0.15 | 0.030 | 0.002 | 0.045 | 0.0030 | 0 | 0.020 | 0.23 | 1.54 | 0.73 | 0.47 | — | 0.05 |
| | C2 | 0.01 | 0.46 | 0.60 | 0.025 | 0.008 | 0.033 | 0.0025 | 0 | 0.010 | 0.15 | 1.48 | 0.40 | 0.27 | — | 0.07 |
| | C3 | 0.02 | 0.51 | 0.15 | 0.040 | 0.009 | 0.025 | 0.0023 | 0 | 0.030 | 0.18 | 0.38 | 0.28 | 0.74 | — | 0.06 |
| | C4 | 0.05 | 0.30 | 0.15 | 0.033 | 0.006 | 0.018 | 0.0040 | 0 | 0.030 | 0.22 | 0.82 | 0.43 | 0.52 | — | 0.08 |
| | C5 | 0.05 | 0.68 | 0.50 | 0.015 | 0.008 | 0.070 | 0.0035 | 0.015 | 0.040 | 0.25 | 0.73 | 0.19 | 0.26 | — | 0.11 |
| | C6 | 0.05 | 0.81 | 1.00 | 0.023 | 0.010 | 0.006 | 0.0028 | 0.010 | 0.020 | 0.27 | 0.86 | 1.33 | 1.55 | — | 0.15 |
| | C7 | 0.08 | 0.61 | 1.20 | 0.040 | 0.003 | 0.040 | 0.0026 | 0.010 | 0.040 | 0.26 | 1.80 | 0.96 | 0.53 | — | 0.18 |
| | C8 | 0.10 | 0.86 | 1.25 | 0.040 | 0.005 | 0.025 | 0.0022 | 0 | 0.050 | 0.35 | 0.62 | 0.43 | 0.69 | — | 0.21 |
| | C9 | 0.08 | 0.01 | 1.48 | 0.014 | 0.006 | 0.048 | 0.0031 | 0.011 | 0.014 | 0.30 | 0.65 | 0.36 | 0.55 | — | 0.17 |
| | C10 | 0.06 | 0.20 | 0.96 | 0.011 | 0.005 | 0.017 | 0.0027 | 0 | 0.007 | 0.07 | 0.73 | 0.36 | 0.49 | — | 0.12 |
| | C11 | 0.07 | 0.72 | 0.48 | 0.018 | 0.007 | 0.065 | 0.0036 | 0.012 | 0.042 | 0.28 | 0.76 | 0.42 | 0.55 | Cr:0.01 Mg:0.002 | 0.14 |
| | C12 | 0.06 | 0.65 | 0.52 | 0.012 | 0.006 | 0.062 | 0.0034 | 0.014 | 0.038 | 0.32 | 0.83 | 0.45 | 0.54 | B:0.0010 V:0.003 | 0.13 |
| Steel sheet of comparative example | D1 | 0.01 | 0.46 | 0.15 | 0.030 | 0.002 | 0.045 | 0.0030 | 0.010 | 0 | 0 | 1.50 | 0.70 | 0.47 | — | 0.03 |
| | D2 | 0.12 | 0.28 | 1.50 | 0.040 | 0.005 | 0.018 | 0.0040 | 0.010 | 0.030 | 0.45 | 0 | 0 | — | — | 0.23 |
| | D3 | 0.20 | 0.22 | 1.00 | 0.042 | 0.006 | 0.018 | 0.0040 | 0 | 0.030 | 0.22 | 0.15 | 0.13 | 0.87 | — | 0.27 |
| | D4 | 0.15 | 0.41 | 1.30 | 0.036 | 0.002 | 0.045 | 0.0030 | 0.015 | 0.020 | 0.15 | 0.50 | 0.32 | 0.64 | — | 0.24 |
| | D5 | 0.12 | 0.35 | 1.80 | 0.047 | 0.005 | 0.035 | 0.0035 | 0.010 | 0.030 | 0.40 | 0.05 | 0.63 | 0.51 | — | 0.25 |
| | D6 | 0.03 | 0.62 | 0.20 | 0.022 | 0.005 | 0.040 | 0.0025 | 0.010 | 0 | 0.30 | 0.86 | 0.54 | 0.63 | — | 0.08 |
| | D7 | 0.15 | 0.50 | 1.65 | 0.018 | 0.005 | 0.039 | 0.0036 | 0 | 0.021 | 0 | 0 | 0.38 | 0.56 | — | 0.25 |
| | D8 | 0.06 | 0.20 | 0.96 | 0.011 | 0.005 | 0.017 | 0.0027 | 0 | 0.040 | 0 | 0.73 | 0.42 | 0.58 | — | 0.11 |
| | D9 | 0.12 | 0.36 | 1.75 | 0.056 | 0.005 | 0.036 | 0.0032 | 0.010 | 0.028 | 0.38 | 0.93 | 0.52 | 0.56 | Cr:0.03 Mg:0.004 | 0.24 |
| | D10 | 0.13 | 0.32 | 1.68 | 0.043 | 0.004 | 0.049 | 0.0036 | 0.015 | 0.034 | 0.42 | 0.88 | 0.45 | 0.51 | B:0.0015 V:0.0004 | 0.25 |

| | | Hot rolling condition (° C.) | | Annealing | Presence | Elongation | Dislocation |
|---|---|---|---|---|---|---|---|
| | No. | Heating temperature | Coiling temperature | temperature (° C.) | of plating | ratio of skinpass (%) | density ( /μm²) |
| Steel sheet of present invention | C1 | 1170 | 480 | 810 | No | 2.0 | 84 |
| | C2 | 1100 | 450 | 850 | " | 1.5 | 63 |
| | C3 | 1050 | 440 | 880 | " | 1.2 | 62 |
| | C4 | 1030 | 480 | 805 | " | 1.5 | 63 |
| | C5 | 1180 | 470 | 830 | " | 3.0 | 121 |
| | C6 | 1140 | 430 | 810 | " | 1.8 | 64 |
| | C7 | 1100 | 490 | 850 | " | 1.5 | 73 |
| | C8 | 1120 | 300 | 820 | Galvanization | 1.2 | 53 |
| | C9 | 1180 | 550 | 810 | Galvanization | 1.5 | 62 |
| | C10 | 1150 | 500 | 805 | Galvanization | 1.5 | 63 |
| | C11 | 1180 | 500 | 840 | No | 1.2 | 58 |
| | C12 | 1180 | 500 | 840 | Galvanization | 1.2 | 57 |

TABLE 4-continued

| | | | | | | | |
|---|---|---|---|---|---|---|---|
| Steel sheet of comparative example | D1 | 1150 | 490 | 770 | No | 1.0 | 49 |
| | D2 | 1250 | 480 | 810 | " | 0.8 | 45 |
| | D3 | 1280 | 680 | 820 | " | 0 | 10 |
| | D4 | 1250 | 700 | 800 | " | 0 | 15 |
| | D5 | 1230 | 420 | 780 | " | 0 | 23 |
| | D6 | 1200 | 560 | 770 | Galvanization | 0 | 17 |
| | D7 | 1050 | 500 | 810 | Galvanization | 1.0 | 51 |
| | D8 | 1150 | 550 | 805 | Galvanization | 1.2 | 53 |
| | D9 | 1180 | 500 | 840 | No | 1.2 | 59 |
| | D10 | 1180 | 500 | 840 | Galvanization | 1.2 | 58 |

TABLE 5

| | | | | | | | Softening characteristic of heat affected zone | | | |
|---|---|---|---|---|---|---|---|---|---|---|
| | | | | | | | Hardness (HvO.1) | | | |
| | | Tensile strength | Fatigue strength | | Formability | | | Most | | Judgement of |
| | No. | (TS) (N/mm$^2$) | (OW) (N/mm$^2$) | OW/TS | Formability index | Judgment of formability *1 | Base metal | softened portion | Difference | softening ratio *2 |
| Steel sheet of the present invention | C1 | 463 | 291 | 0.63 | 0.95 | ○ | 141 | 141 | 0 | ○ |
| | C2 | 495 | 307 | 0.62 | 0.92 | ○ | 150 | 148 | 2 | ○ |
| | C3 | 498 | 289 | 0.58 | 0.90 | ○ | 152 | 150 | 2 | ○ |
| | C4 | 549 | 340 | 0.62 | 0.89 | ○ | 162 | 159 | 3 | ○ |
| | C5 | 561 | 330 | 0.59 | 0.91 | ○ | 170 | 170 | 0 | ○ |
| | C6 | 695 | 431 | 0.62 | 0.92 | ○ | 185 | 184 | 1 | ○ |
| | C7 | 765 | 497 | 0.65 | 0.89 | ○ | 207 | 205 | 2 | ○ |
| | C8 | 817 | 498 | 0.61 | 0.82 | ○ | 222 | 221 | 1 | ○ |
| | C9 | 623 | 386 | 0.62 | 0.88 | ○ | 196 | 195 | 1 | ○ |
| | C10 | 524 | 330 | 0.63 | 0.86 | ○ | 161 | 152 | 9 | ○ |
| | C11 | 606 | 370 | 0.61 | 0.83 | ○ | 173 | 172 | 1 | ○ |
| | C12 | 588 | 371 | 0.63 | 0.84 | ○ | 172 | 172 | 0 | ○ |
| Steel sheet of the comparative example | D1 | 431 | 276 | 0.64 | 0.93 | ○ | 139 | 108 | 31 | x |
| | D2 | 667 | 286 | 0.43 | 0.75 | x | 198 | 197 | 1 | ○ |
| | D3 | 606 | 291 | 0.48 | 0.35 | x | 182 | 180 | 2 | ○ |
| | D4 | 709 | 426 | 0.60 | 0.53 | x | 204 | 199 | 5 | ○ |
| | D5 | 729 | 335 | 0.46 | 0.76 | x | 203 | 203 | 0 | ○ |
| | D6 | 451 | 284 | 0.63 | 0.92 | ○ | 142 | 124 | 18 | x |
| | D7 | 591 | 260 | 0.44 | 0.72 | x | 172 | 141 | 31 | x |
| | D8 | 485 | 301 | 0.62 | 0.89 | ○ | 153 | 123 | 30 | x |
| | D9 | 711 | 448 | 0.63 | 0.38 | x | 208 | 206 | 2 | ○ |
| | D10 | 737 | 472 | 0.64 | 0.36 | x | 210 | 209 | 1 | ○ |

*1) Judgment of formability: A case in which formability index > 0.8 is qualified as ○ (excellent).
*2) Judgment of softening ratio: A case in which a difference in hardness is lower than 10 is qualified as ○ (excellent).

TABLE 6

| | Combination of steel sheets | | | | | | Softening characteristic of heat affected zone | | | |
|---|---|---|---|---|---|---|---|---|---|---|
| | Type of steel | Wall thickness (nm) | Type of steel | Wall thickness (nm) | Welding method | Formability index *1 | Strength of base metal (HvO.1) *2 | Hardness of most softened portion (HvO.1) | Difference | Judgment of softening ratio *3 |
| Steel sheet of present invention + Steel sheet of the present invention | C1 | 1.4 | C1 | 1.4 | Laser welding | 0.95 | 140 | 140 | 0 | ○ |
| | C1 | 1.4 | C9 | 1.4 | " | 0.85 | " | 139 | 1 | ○ |
| | C1 | 1.4 | C8 | 1.4 | " | 0.80 | " | 140 | 0 | ○ |
| | C1 | 1.4 | C1 | 1.4 | Mash seam welding | 0.97 | " | 138 | 2 | ○ |
| | C1 | 1.4 | C9 | 1.4 | " | 0.92 | " | 137 | 3 | ○ |
| | C1 | 1.4 | C8 | 1.4 | " | 0.82 | " | 137 | 3 | ○ |
| | C1 | 1.4 | C1 | 1.4 | Plasma welding | 0.93 | " | 140 | 0 | ○ |
| | C1 | 1.4 | C9 | 1.4 | " | 0.84 | " | 139 | 1 | ○ |
| | C1 | 1.4 | C8 | 1.4 | " | 0.79 | " | 139 | 1 | ○ |
| | C1 | 1.0 | C1 | 1.4 | Laser welding | 0.86 | 139 | 139 | 0 | ○ |
| | C1 | 1.0 | C9 | 1.4 | " | 0.84 | " | 139 | 0 | ○ |
| | C1 | 1.0 | C8 | 1.4 | " | 0.80 | " | 139 | 0 | ○ |
| | C1 | 0.8 | C1 | 1.4 | " | 0.82 | 141 | 140 | 1 | ○ |
| | C1 | 0.8 | C9 | 1.4 | " | 0.78 | " | 141 | 0 | ○ |

TABLE 6-continued

| | Combination of steel sheets | | | | | | Softening characteristic of heat affected zone | | | |
|---|---|---|---|---|---|---|---|---|---|---|
| | Type of steel | Wall thickness (nm) | Type of steel | Wall thickness (nm) | Welding method | Formability index *1 | Strength of base metal (HvO.1) *2 | Hardness of most softened portion (HvO.1) | Difference | Judgment of softening ratio *3 |
| | C1 | 0.8 | C8 | 1.4 | " | 0.77 | " | 140 | 1 | ○ |
| | C1 | 1.0 | C1 | 1.4 | Mash seam welding | 0.88 | 139 | 138 | 1 | ○ |
| | C1 | 1.0 | C9 | 1.4 | " | 0.85 | " | 137 | 2 | ○ |
| | C1 | 1.0 | C8 | 1.4 | " | 0.81 | " | 135 | 4 | ○ |
| | C1 | 0.8 | C1 | 1.4 | " | 0.85 | 141 | 140 | 1 | ○ |
| | C1 | 0.8 | C9 | 1.4 | " | 0.80 | " | 139 | 2 | ○ |
| | C1 | 0.8 | C8 | 1.4 | " | 0.79 | " | 139 | 2 | ○ |
| | C1 | 1.0 | C1 | 1.4 | PLasma welding | 0.84 | 139 | 139 | 0 | ○ |
| | C1 | 1.0 | C9 | 1.4 | " | 0.81 | " | 139 | 0 | ○ |
| | C1 | 1.0 | C8 | 1.4 | " | 0.80 | " | 139 | 0 | ○ |
| | C1 | 0.8 | C1 | 1.4 | " | 0.75 | 141 | 140 | 1 | ○ |
| | C1 | 0.8 | C9 | 1.4 | " | 0.70 | " | 140 | 1 | ○ |
| | C1 | 0.8 | C8 | 1.4 | " | 0.65 | " | 140 | 1 | ○ |
| Steel sheet of | C9 | 1.4 | D1 | 1.0 | Plasma welding | 0.93 | 138 | 108 | 30 | x |
| present | C9 | 1.4 | D1 | 1.4 | Mash seam welding | 0.95 | " | 105 | 33 | x |
| invention + | C9 | 1.4 | D1 | 1.4 | Plasma welding | 0.91 | " | 106 | 32 | x |
| Steel sheet of | C9 | 1.4 | D1 | 1.0 | Laser welding | 0.83 | 139 | 98 | 42 | x |
| the | C9 | 1.4 | D1 | 1.0 | Mash seam welding | 0.85 | " | 95 | 44 | x |
| comparative | C9 | 1.4 | D1 | 1.0 | Plasma welding | 0.80 | " | 97 | 42 | x |
| example | C9 | 1.4 | D3 | 1.4 | Laser welding | 0.67 | 182 | 181 | 1 | ○ |
| | C9 | 1.4 | D3 | 1.4 | Mash seam welding | 0.72 | " | 180 | 2 | ○ |
| | C9 | 1.4 | D3 | 1.4 | Plasma welding | 0.65 | " | 181 | 1 | ○ |
| | C9 | 1.4 | D3 | 1.0 | Laser welding | 0.65 | 180 | 180 | 0 | ○ |
| | C9 | 1.4 | D3 | 1.0 | Mash seam welding | 0.68 | " | 179 | 1 | ○ |
| | C9 | 1.4 | D3 | 1.0 | Plasma welding | 0.63 | " | 180 | 0 | ○ |
| Steel sheet of | D1 | 1.4 | D1 | 1.0 | Laser welding | 0.87 | 139 | 109 | 30 | x |
| comparative | D1 | 1.4 | D1 | 1.0 | Mash seam welding | 0.89 | " | 108 | 31 | x |
| example + | D1 | 1.4 | D1 | 1.0 | Plasma welding | 0.85 | " | 108 | 31 | x |
| steel sheet of | D1 | 1.4 | D3 | 1.4 | Laser welding | 0.36 | 138 | 105 | 33 | x |
| comparative | D1 | 1.4 | D3 | 1.4 | Mash seam welding | 0.40 | " | 100 | 38 | x |
| example | D1 | 1.0 | D3 | 1.4 | Plasma welding | 0.30 | " | 102 | 36 | x |
| | D1 | 0.8 | D3 | 1.0 | Laser welding | 0.35 | " | 110 | 28 | x |
| | D1 | 0.8 | D3 | 1.0 | Mash seam welding | 0.39 | " | 103 | 35 | x |
| | D1 | 0.8 | D3 | 1.0 | Plasma welding | 0.28 | " | 108 | 30 | x |

*1) Formability index: Formability index is a value obtained by following; the punch-stretch height of the weld zone under each condition was divided by the critical punch-stretch height of the weld zone in the case which the steel sheets of the same type of steel and the same thickness are butt-welded to each other.
*2) Hardness of base metal: In the case of a combination of steel sheets of different types of steel, hardness of a steel sheet of lower hardness was determined to be hardness of the base metal.
*3) Judgment of softening ratio: When a difference in hardness was smaller than 10, the softening ratio was determined to be ○ (excellent).

INDUSTRIAL APPLICABILITY

According to the present invention, it is possible to provide high-strength steel sheets such as high-strength hot-rolled steel sheets, high-strength cold-rolled steel sheets or high-strength surface-treated steel sheets, the formability after welding of which is excellent and, further, the fatigue property of which is excellent and, furthermore, the heat affected zone of which seldom softens. Therefore, it can be expected that the present invention provides great industrial effects.

What is claimed is:

1. A high-strength steel sheet having excellent formability and resistance to softening of the heat affected zone after welding, comprising the following components expressed by mass %, C: 0.02 to 0.15%

Si: 0.005 to 1.0%

Mn: 0.1 to 2.2%

P: 0.001 to 0.06%

S: 0.001 to 0.01%

N: 0.0005 to 0.01%

Al: 0.001 to 0.1%

Nb: 0.005 to 0.05%

Mo: 0.05 to 0.5%

Fe: principal component where the components satisfy the following expression (A), and the dislocation density per plane visual field of 1 $\mu m^2$ is not less than 50/$\mu m^2$ and not more than 10,000/$\mu m^2$;

$$0.22 \geqq C(\%)+(Si/30)(\%)+(Mn/20)(\%)+(Mo/15)(\%) \quad (A).$$

2. A high-strength steel sheet having excellent formability and resistance to softening of the heat affected zone after welding, comprising the following components expressed by mass %, C: 0.02 to 0.15%

Si: 0.005 to 1.0%

Mn: 0.1 to 2.2%

P: 0.001 to 0.06%

S: 0.001 to 0.01%

N: 0.0005 to 0.01%

Al: 0.001 to 0.1%

Nb: 0.005 to 0.05%

Mo: 0.05 to 0.5%

Ti: 0.001 to 0.02%

Fe: principal component where the components satisfy the following expression (A);

$$0.22 \geqq C(\%)+(Si/30)(\%)+(Mn/20)(\%)+(Mo/15)(\%) \quad (A).$$

3. A high-strength steel sheet having excellent formability and resistance to softening of the heat affected zone after welding, comprising the following components expressed by mass %, C: 0.02 to 0.15%

Si: 0.005 to 1.0%

Mn: 0.1 to 2.2%

P: 0.001 to 0.06%

S: 0.001 to 0.01%

N: 0.0005 to 0.01%

Al: 0.001 to 0.1%

Nb: 0.005 to 0.05%

Mo: 0.05 to 0.5%

Ti: 0.001 to 0.02%

Fe: principal component where the components satisfy the following expression (A), and the dislocation density per plane visual field of 1 $\mu m^2$ is not less than $50/\mu m^2$ and not more than $10{,}000/\mu m^2$;

$$0.22 \geqq C(\%)+(Si/30)(\%)+(Mn/20)(\%)+(Mo/15)(\%) \quad (A).$$

4. A high-strength steel sheet having excellent formability and resistance to softening of the heat affected zone after welding, according to claim 1, 2 or 3, wherein the high strength steel sheet is a high-strength hot-rolled steel sheet.

5. A high strength steel sheet having excellent formability and resistance to softening of the heat affected zone after welding, according to claim 1, 2 or 3, wherein the high-strength steel sheet is a high-strength cold-rolled steel sheet.

6. A high-strength steel sheet having excellent formability and resistance to softening of the heat affected zone after welding, according to claim 1, 2, or 3, wherein the high-strength steel sheet is a high-strength surface-treated steel sheet.

7. A high-strength surface-treated steel sheet having excellent formability and resistance to softening of the heat affected zone after welding, according to claim 6, wherein the high-strength surface-treated steel sheet is a high-strength galvanized steel sheet.

8. A high-strength steel sheet having excellent fatigue property, excellent formability and resistance to softening of the heat affected zone after welding, comprising the following components expressed by mass %, C: 0.02 to 0.15%

Si: 0.005 to 1.0%

Mn: 0.1 to 2.2%

P: 0.001 to 0.06%

S: 0.001 to 0.01%

N: 0.0005 to 0.01%

Al: 0.001 to 0.1%

Nb: 0.005 to 0.05%

Mo: 0.05 to 0.5%

Cu: 0.2 to 2.0%

Ni: 0.05 to 2.0%

Fe: principal component where the components satisfy the following expression (A);

$$0.22 \geqq C(\%)+(Si/30)+(Mn/20)(\%)+(Mo/15)(\%) \quad (A).$$

9. A high-strength steel sheet having excellent fatigue property, excellent formability and resistance to softening of the heat affected zone after welding, comprising the following components expressed by mass %, C: 0.02 to 0.15%

Si: 0.005 to 1.0%

Mn: 0.1 to 2.2%

P: 0.001 to 0.06%

S: 0.001 to 0.01%

N: 0.0005 to 0.01%

Al: 0.001 to 0.1%

Nb: 0.005 to 0.05%

Mo: 0.05 to 0.5%

Cu: 0.2 to 2.0%

Ni: 0.05 to 2.0%

Fe: principal component where the components satisfy the following expression (A), and the dislocation density per plane visual field of 1 $\mu m^2$ is not less than $50/\mu m^2$ and not more than $10{,}000/\mu m^2$;

$$0.22 \geqq C(\%)+(Si/30)(\%)+(Mn/20)(\%)+(Mo/15)(\%) \quad (A).$$

10. A high-strength steel sheet having excellent fatigue property, excellent formability and resistance to softening of the heat affected zone after welding, comprising the following components expressed by mass %, C: 0.02 to 0.15%

Si: 0.005 to 1.0%

Mn: 0.1 to 2.2%

P: 0.001 to 0.06%

S: 0.001 to 0.01%

N: 0.0005 to 0.01%

Al: 0.001 to 0.1%

Nb: 0.005 to 0.05%

Mo: 0.05 to 0.5%

Ti: 0.001 to 0.02%

Cu: 0.2 to 2.0%

Ni: 0.05 to 2.0%

Fe: principal component where the components satisfy the following expression (A);

$$0.22 \geqq C(\%)+(Si/30)(\%)+(Mn/20)(\%)+(Mo/15)(\%) \quad (A).$$

11. A high-strength steel sheet having excellent fatigue property, excellent formability and resistance to softening of the heat affected zone after welding, comprising the following components expressed by mass %, C: 0.02 to 0.15%

Si: 0.005 to 1.0%

Mn: 0.1 to 2.2%

P: 0.001 to 0.06%

S: 0.001 to 0.01%

N: 0.0005 to 0.01%

Al: 0.001 to 0.1%

Nb: 0.005 to 0.05%

Mo: 0.05 to 0.5%

Ti: 0.001 to 0.02%

Cu: 0.2 to 2.0%

Ni: 0.05 to 2.0%

Fe: principal component where the components satisfy the following expression (A), and the dislocation density per plane visual field of 1 $\mu m^2$ is not less than $50/\mu m^2$ and not more than $10{,}000/\mu m^2$;

$$0.22 \geqq C(\%)+(Si/30)(\%)+(Mn/20)(\%)+(Mo/15)(\%) \quad (A).$$

12. A high-strength steel sheet having excellent fatigue property, excellent formability and resistance to softening of the heat affected zone after welding, according to claim 8, 9, 10 or 11, wherein the high-strength steel sheet is a high-strength hot-rolled steel sheet.

13. A high-strength steel sheet having excellent fatigue property, excellent formability and resistance to softening of the heat affected zone after welding, according to claim 8, 9, 10 or 11, wherein the high-strength steel sheet is a high-strength cold-rolled steel sheet.

14. A high-strength steel sheet having excellent fatigue property, excellent formability and resistance to softening of the heat affected zone after welding, according to claim 8, 9, 10 or 11, wherein the high-strength steel sheet is a high-strength surface-treated steel sheet.

15. A high-strength surface-treated steel sheet having excellent fatigue property, excellent formability and resistance to softening of the heat affected zone after welding, according to claim 14, wherein the high-strength surface-treated steel sheet is a high-strength galvanized steel sheet.

* * * * *